US006293523B1

(12) United States Patent
Fendler

(10) Patent No.: US 6,293,523 B1
(45) Date of Patent: Sep. 25, 2001

(54) ANGLE ADJUSTABLE RETAINING WALL AND FENCING SYSTEM

(76) Inventor: Larry R. Fendler, 1803 Lemay Ferry Rd., St. Louis, MO (US) 63125

( * ) Notice: Subject to any disclaimer, the term of this patent is extended or adjusted under 35 U.S.C. 154(b) by 0 days.

(21) Appl. No.: 09/468,553

(22) Filed: Dec. 21, 1999

Related U.S. Application Data

(60) Provisional application No. 60/113,196, filed on Dec. 22, 1998.

(51) Int. Cl.[7] ..... E04H 17/14

(52) U.S. Cl. ..... 256/27; 256/24; 256/67

(58) Field of Search ..... 256/24, 26, 27, 256/28, 60, 67; 52/768, 775, 780

(56) References Cited

U.S. PATENT DOCUMENTS

| | | | | |
|---|---|---|---|---|
| 2,090,762 | * | 8/1937 | Lowery | 52/768 |
| 3,371,454 | * | 3/1968 | Anderson | 52/768 |
| 4,054,268 | * | 10/1977 | Sher | 52/768 |
| 4,114,860 | | 9/1978 | Parisien . | |
| 4,477,058 | | 10/1984 | Lowery . | |
| 4,674,593 | | 6/1987 | McCarty . | |
| 4,809,955 | | 3/1989 | Veilleux . | |
| 4,982,535 | | 1/1991 | Pickett . | |
| 5,291,708 | | 3/1994 | Johnson . | |
| 5,315,802 | | 5/1994 | Hart . | |
| 5,372,354 | | 12/1994 | Cacicedo . | |
| 5,383,739 | | 1/1995 | Haglund . | |
| 5,452,880 | | 9/1995 | Baily . | |
| 5,538,363 | | 7/1996 | Eastwood . | |
| 5,609,327 | | 3/1997 | Amidon . | |
| 5,649,689 | | 7/1997 | Wilson . | |
| 5,653,546 | | 8/1997 | Cronkhite et al. . | |
| 5,671,584 | | 9/1997 | Mueller . | |
| 5,702,090 | | 12/1997 | Edgman . | |

* cited by examiner

*Primary Examiner*—Lynne H. Browne
*Assistant Examiner*—John R. Cottingham
(74) *Attorney, Agent, or Firm*—Kevin L. Klug

(57) ABSTRACT

A system and apparatus for creating an angle adjustable retaining wall or fencing system which allows an installer to create a retaining wall, bin, fence, or related structure which may be placed with continuous angles between wall sections. The apparatus comprises one or more posts each having a special formed primary slot and one or more planks each having specialty sliding pins mounted within holes on the ends of the planks. The ends of the planks with the slidable pins fit within and are secured by the primary slots and are able to angularly move internally and externally to the primary slot while maintaining structural integrity in all axis. The plank movement allows for angles between wall sections which are not exactly 90 or 180 degrees.

9 Claims, 3 Drawing Sheets

ANGLE ADJUSTABLE RETAINING WALL AND FENCING SYSTEM

This application claims priority of Provisional Patent Application No. 60/113,196, filed Dec. 22, 1998.

BACKGROUND OF THE INVENTION

The present invention relates in general to fencing and retaining wall systems and more particularly, to an apparatus and method for creating fences, retaining walls, and related structures which are capable of having fully adjustable angles between the sections.

Traditionally, retaining walls and walls for bins and fences have been limited to strait line runs or runs with a 90° relation between wall sections. Providing for angles between wall sections which are not exactly 90 or 180° between sections and yet also structurally strong has been difficult. Heretofore, provision of said angles required much time and effort on the part of the installation crew. The art of the present invention alleviates this time and effort by providing a system and method which allows the installation crew to install a wall for a fence, bin or retaining structure which is easily capable of angular adjustment in the running plane of the wall.

Typically, retaining walls, bins and fences are formed from a plurality of posts between which are attached one or more planks. Traditionally, planks are nailed or screwed to the flat face of the post, thus limiting plank angles to inline (180°) or orthogonal (90°) since a square post typically has four right angle corners. Since most posts are of rectangular cross section, typically the walled structure is limited to a rectangular form. Deviations from a rectangular form have been possible, but not without much additional work on the part of the installation crew. That is, traditionally special angles or cuts were required on the post or the plank or the plank was toenailed into place. The present invention utilizes a post having one or more uniquely shaped primary slots into which each plank fits. The unique shape of the slot provides for easy angular movement and installation of the plank without sacrificing the strength of the constructed wall.

Prior to the art of the present invention, the installer of a fence, bin or retaining structure needed specialty tools and further had to cut planks and posts with special angles in order to create a structure with angles other than 90° or 180° between sections. This limited the post and plank materials to wood or other materials which could typically be cut with hand tools. Furthermore, It slowed installation and required installers with special skills. Moreover, strength of the finished product was often compromised due to the structural interface and due to the materials used. Very strong materials such as pultruded fiberglass or metallic structures were typically not used for posts, planks, or sections due to the difficulty of cutting, angling, and attaching the posts, planks and sections. The art of the present invention provides a uniquely slotted post and uniquely structured plank which allow an installer to move the plank and related section through a range of continuous positive and negative angle relative to the post onto which it is attached. In a preferred embodiment the range is typically ±25° from the 90° mating with the post.

Accordingly, it is an object of the present invention to provide an angle adjustable retaining wall and fencing system and apparatus which allows an installer to create a retaining wall, bin, fence, or related structure which may be placed with continuous adjustable angles between wall sections and not limited to only 90° or 180° between the wall sections of the structure.

Another object of the present invention is to provide an angle adjustable retaining wall and fencing system and apparatus which is capable of installation with a minimum of specialty tools.

A further object of the present invention is to provide an angle adjustable retaining wall and fencing system and apparatus which does not require skilled labor to install.

A still further object of the present invention is to provide an angle adjustable retaining wall and fencing system and apparatus which is structurally stronger than conventional systems.

A still further object of the present invention is to provide an angle adjustable retaining wall and fencing system and apparatus which is capable of manufacture from pultruded fiberglass or other high strength structural materials.

SUMMARY OF THE INVENTION

To accomplish the foregoing and other objects of this invention there is provided an angle adjustable retaining wall and fencing system and apparatus therefore. The system and apparatus provide for the construction of retaining walls, fencing systems, bins, and other structures by uniquely connecting one or more specially formed wall sections with one or more specially formed posts. In a preferred embodiment, the apparatus comprises at least one post having at least one primary slot and one or more planks mounted within said primary slot. Each plank has one or more end holes with moveable pins mounted within said holes for securing of said plank within said primary slot. A wall section is formed from one or more planks. Moreover, each post may have more than one primary slot.

It is important to note that the preferred embodiment provides for continuous angular movement of the one or more planks within a fixed angle range around a vertically placed post. That is, if the post were considered a cylinder with two ends and an outer surface, the end of the plank not attached to the post would rotate quasi tangentially to the outer surface of the cylinder and maintain a substantially fixed distance from each of said two ends. The post could be of any cross sectional shape between said two ends with the same general description of plank and post interaction. Such cross sections are represented by any polygonal shape including but not limited to circular, square, elliptical, and hexagonal.

In preferred and alternative embodiments, the primary slot runs substantially parallel with the end to end axis of the post and also much of the length of said post. The slot is of uniform cross section when viewed as a slice taken perpendicularly with and across the axis of the post. Thus, a description of said primary slot geometry in relation to said cross section provides the required slot description for utilization of the present art. The cross section of the uniquely shaped primary slot is first comprised of an opening in the outer surface of said post which is typically only slightly larger than the thickness of an insertable plank, said opening thereby forming a slot face. Said primary slot cross section further comprises two or more side walls which intersect each edge of said slot face and are angled outward from the inserted plank, thus forming an internal slot cross section which is wider than that of said slot face. This allows for movement of the plank end in the slot in a direction which is orthogonal to the plane of the wall and the post axis. This allows the plank end opposite the slot to rotate as described. The back wall connects the side walls in such a manner as to provide for the desired angular movement of said plank. That is, the width and compound radius structure of the back wall serve as a limit on the movement of the edges of the plank end within the primary slot.

An alternative embodiment incorporates a subslot within the back wall for fixed positioning of the plank without adjustment. That is, a plank fits within the subslot so that angular movement of the plank is prohibited. Typically the subslot is placed in order to ensure a straight or inline (180°) positioning of the plank and wall section but may be placed at any location on the back wall. When desired, the positioning of the plank end holes and thereby the moveable pins within them is such that the plank end fits firmly within the subslot.

In order to secure said plank to said post, one or more pins are placed within holes near an end of said plank before said end is installed into said post. Each of said pins are slidable within their respective holes in said plank in order to allow for the angular movement of said plank. The holes are typically perpendicular to the length axis of the plank. Portions of each of said pins butt against the side walls and snugly hold said plank in said slot and also against said back wall while allowing said plank to be angularly moved. That is, since the pins are moveable within said holes, when the plank is moved through its allowed angle, the pins move within said holes while maintaining contact with the side walls and also ensuring that portions of the inserted plank end contact the back wall for structural integrity. Thus the plank is secured within the post and has movement only angularly around the central axis of the post.

A unique inventive concept of the present invention lies in the shape, structure, and function of the primary slot within the post in addition to the slot interaction with each plank having a hole and pin structure. The unique interaction of the two allows for a plank to be moved relative to the post through a continuous angle range. The angle range is limited by the factors of a first side wall angle and second side wall angle, a slot face width, a plank thickness, hole and pin location in the plank, pin length in the holes, and the shape and location of a back wall of the primary slot. In a preferred embodiment, the continuous angle range is approximately ±25°. Alternative embodiments alter the aforementioned limiting factors to obtain an expanded or reduced continuous plank angle range. The essential elements of the present art which provide for its unique function can be summarized as a primary slot with an interior cross section which is greater in width than its slot face, and a plank having moveable end pins which hold the plank within said primary slot.

Further alternative embodiments alter the location of the holes in the ends of the planks in order to provide angular adjustment relative to the axis formed between the two ends of the cylinder. That is, since each hole contains a pin which holds each plank within the primary slot, position of said pins closer to the end of said plank allows for more movement relative to the axis of the post. If more than one pin is used on the end of a plank, often they are placed in a staggered position for the aforementioned angular adjustment. In many embodiments, if a primary slot contains a subslot, the plank holes are located farther from the plank end which is inserted within the primary slot in order to ensure positive retention within said subslot.

Further provided are fittings to hold said planks in a proper position within said slot and provide for a proper and finished look. These include a rail stop to hold said plank in the proper vertical position within said slot, a filler cap to cover said slot when a plank is not placed within, a post cap to cover the slot cross section at the top of said post, and bottom anchor strips to help further secure the lower portions of said plank. The rail stop is simply a piece of material which fits into the primary slot and prevents the plank from sliding downward. Often the rail stop is attached to the back or side walls of the primary slot. The anchor strip is typically an "L" shaped bracket which is secured to the earth or other structure, typically by reinforcement rod, and positioned so that the lip of the "L" shape holds a portion of the plank. The anchor strip allows for greater weight retention, especially for a retaining wall.

In use, the user first installs the aforesaid posts with the proper footing. The user then inserts one or more pins into the holes at the end of a plank and slides said pin and plank end combination into one of said primary slots from the topmost part of said post. That is, the plank with pins is slid within the primary slot from an end of the post to the desired position. Should the user desire to place said plank at a measured location within said slot, the user will place and secure a rail stop within said slot to limit the position of said plank. Typically, the user slides a plank between two posts, both having the aforementioned primary slot. Since the present art allows for angular placement of said plank, the two posts need not be perfectly aligned. Upon installation of the desired number of planks, the user may install a filler cap into said slot and a post cap over said post. Further installation of an anchor strip onto said plank may follow if the user deems that the situation warrants. That is, if further reinforcement of one or more planks is required.

It is important to note that the post/slot combination may take many forms. That is, a post with one, two, three, four or more primary slots is possible. The internal cross section of the post may further contain hollow sections for optimization of the weight or structural strength. This is especially true when the post is manufactured from pultruded fiberglass. The posts and planks may further be manufactured from a plurality of materials which provide the structural strength necessary for the application. These include but are not limited to, wood, plastic, metal, composites, pultruded fiberglass, ceramic, and concrete.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
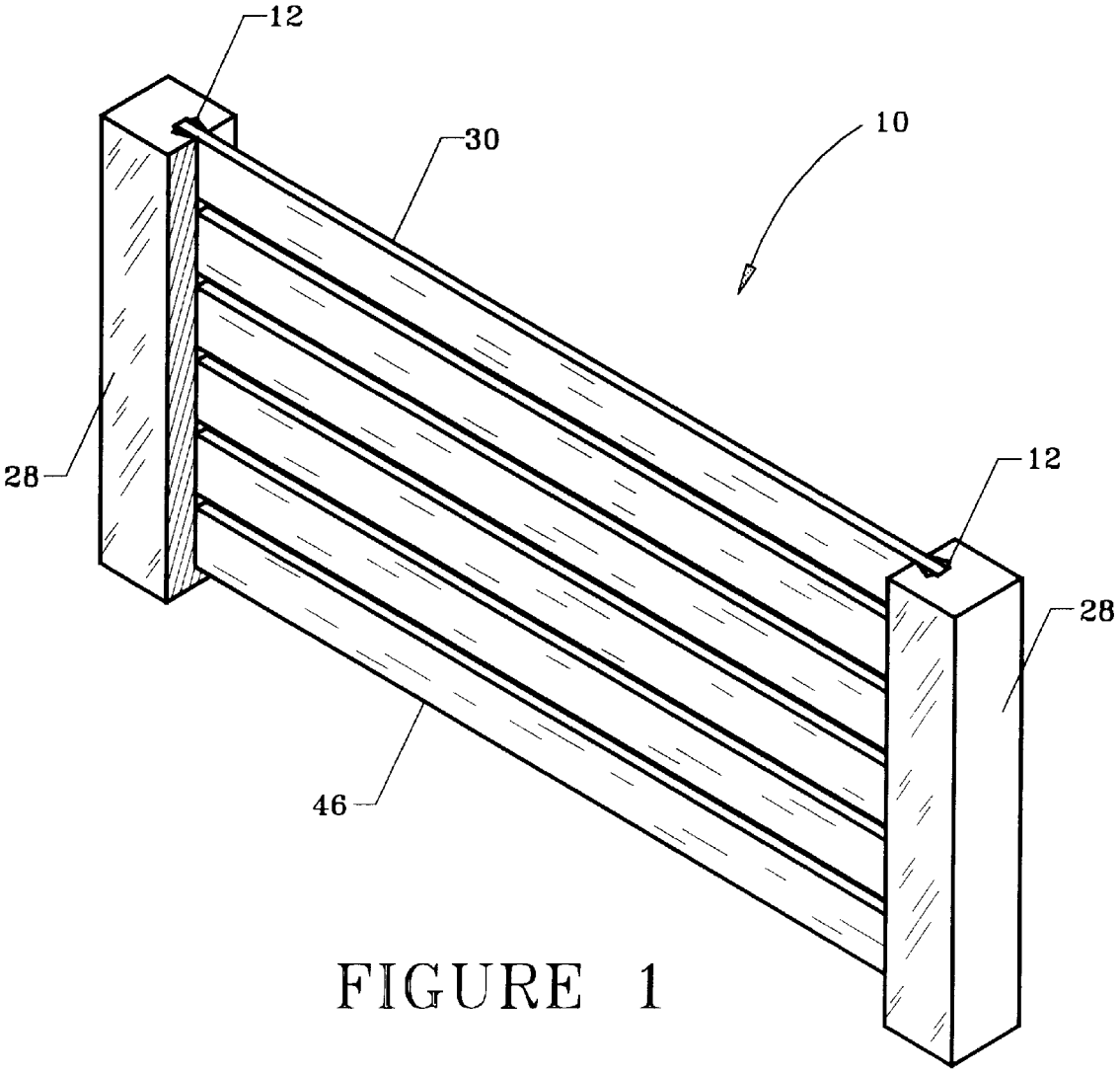
FIG. 1 is a plan view of an angle adjustable retaining wall and fencing system showing two posts having primary slots and six planks which form a wall section mounted between said posts.
Figure 2:
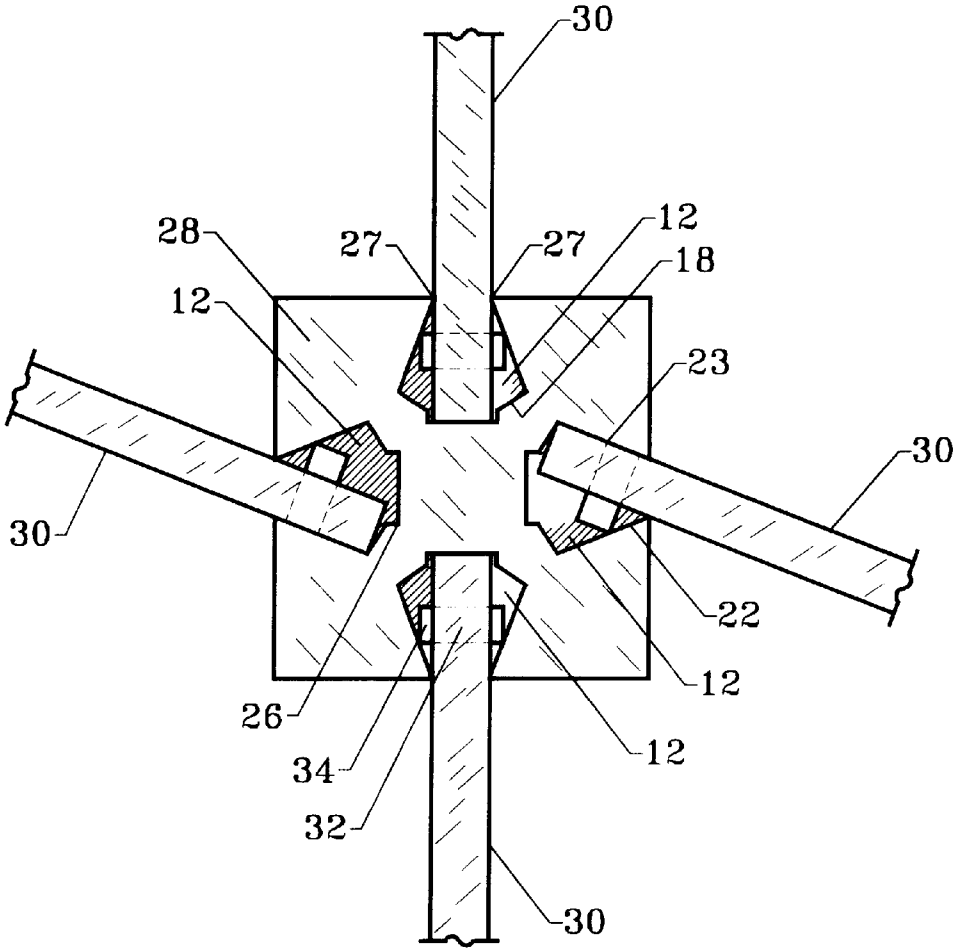
FIG. 2 is a top plan view of a post of an angle adjustable retaining wall and fencing system showing four primary slots with subslots, pins, and planks positioned at various angles.
Figure 4:
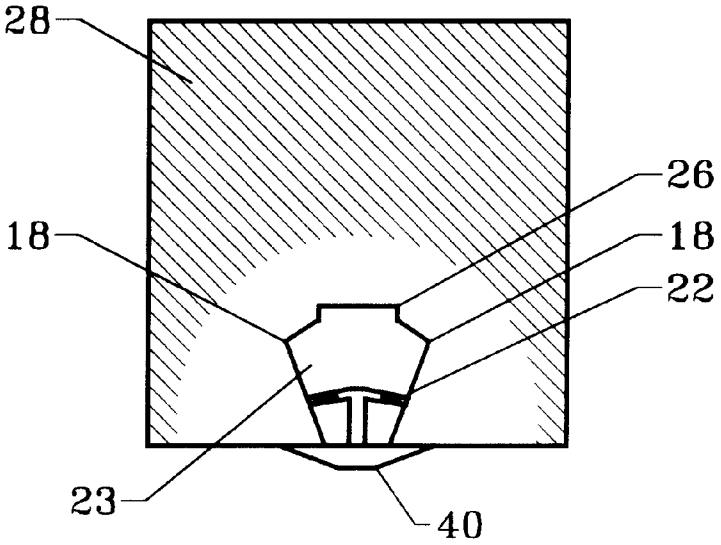
FIG. 4 is a top plan view of a post of an angle adjustable retaining wall and fencing system showing a primary slot with a subslot, and primary slot filler cap.
Figure 3:
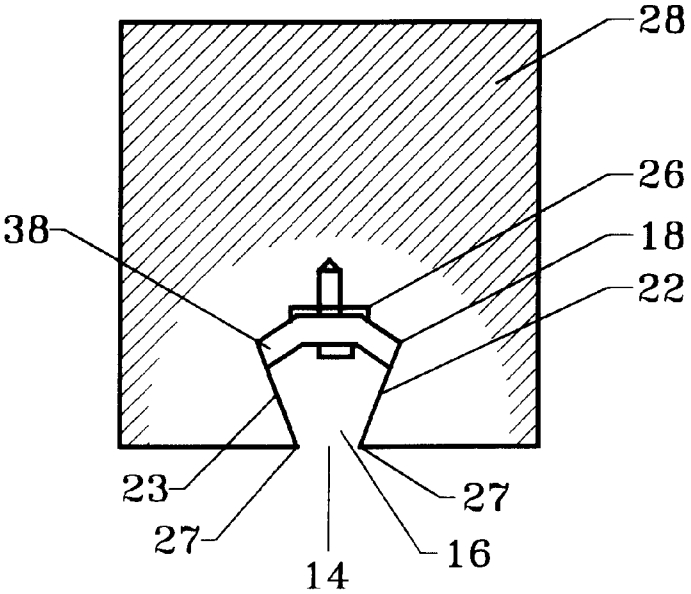
FIG. 3 is a top plan view of a post of an angle adjustable retaining wall and fencing system showing a primary slot with a subslot, and rail stop.

Referring now to the drawings, there is shown in FIGS. 1–4 an angle adjustable retaining wall and fencing system 10 and associated apparatus. The angle adjustable retaining wall and fencing system 10 is particularly adapted for constructing retaining walls, fences, bins, and related structures, especially when angles other than 90° or 180° are desired between wall sections 46.

The drawings show the apparatus comprising a post 28, a primary slot 12, one or more planks 30, and rail stop 38 and filler cap 40 fittings. The system as a whole uses numerous posts 28, planks 30 and fittings 38, 40 in order to create a desired structure. Said system further uses established post caps and anchor strips where appropriate. The unique interaction of the primary slot 12 and the planks 30 which form a wall section 46 which is capable of continuous angular movement within a limited range is critical to the operation of the system 10.

Each post 28 contains one or more primary slots 12 which run substantially parallel with the length axis of the post 28. Since each slot 12 operates upon the same geometric principles, description of the art is provided by describing the operation of one or more planks 30 in conjunction with a single primary slot 12. Furthermore, since the primary slot 12 is uniform along its run, description of the slot 12 cross section provides the necessary disclosure for those skilled in the art.

Each primary slot 12 is first comprised of an opening 14 in the outer surface of said post 28 which forms a slot face 16 having two edges which are fulcrum points 27. Said opening 14 is typically only slightly larger than the thickness of a plank 30 which inserts therein. Said primary slot 12 cross section further comprises two or more side walls 22, 23 which intersect each edge of said slot face 16 and are typically angled outward and away from said fulcrum points 27 and a plank 30 inserted into said primary slot 12. The present art therefore has a distance between said side walls 22, 23 which progressively widens within the depth of the primary slot 22.

The greater width of the side walls 22, 23 allows for movement of the plank 30 end in the slot in a direction which is orthogonal to the plane of the wall 46 and around the post 28 axis. That is, the plank 30 is able to pivot at the fulcrum points 27 formed at the slot face 16 and follow the contours of the back wall 18. This allows the plank 30 end opposite the primary slot 12 to rotate or pivot as described. The back wall 18 connects the side walls 22, 23 in such a manner as to provide for the desired angular movement of said plank 30. That is, the width and compound radius structure of the back wall 18 serve as a limit on the 2-axis movement of the edges of the plank 30 end within the primary slot 12. The 2-axis movement is defined as a plane which parallel with the end-to-end axis of the post 28.

Each plank 30 contains one or more pins 34 slidably mounted within holes 32 near an end of said plank 30. Each of said pins 34 are slidable within their respective holes 32 in said plank 30 in order to allow for the aforesaid continuous angular movement of said plank 30. The holes 32 are typically perpendicular to the length axis of the plank 30, but could be at angles other than perpendicular and also function as herein described. The location of each hole 32 is such that the plank 30 end and the hole 32, with a proper length pin 34 inserted, may fit within the primary slot 12.

Each pin 34 is cut to a length which ensures that portions of each of the pin 34 butt against the side walls 32, 33 while snugly holding said plank 30 end in said primary slot 12 against said back wall 18. Since said pins 34 are slidable within the holes 32 while contacting said side walls 22, said plank 30 is angularly moveable on said fulcrum points 27. That is, since the pins 34 are moveable within said holes 32, when the plank 30 is moved through its allowed angle, the pins 34 move within said holes 32 while maintaining contact with the side walls 32, 33 and also ensuring that portions of the inserted plank 30 end contact the back wall 18 for structural integrity. Thus the plank 30 is secured within the post 28 and has movement only angularly in a quasi tangential manner around the central axis of the post 28. The aforementioned angle range is limited by the factors of the first side wall 22 angle, the second side wall angle 23, the slot face 16 width, the plank 30 thickness, hole 32 and pin 34 location in the plank 30, pin 34 length in the holes 32, and the shape and location of the back wall 18 of the primary slot 12. In a preferred embodiment, the continuous angle range is approximately ±25°. Alternative embodiments could provide continuous angle ranges approaching ±90°. The number of factors which affect angle range is so diverse that a concise mathematical description of the angle range limits which takes into account all of the factors is not possible.

Further alternative embodiments move one or more of the holes 32 and the corresponding pins 34 in the ends of the planks toward the end of the plank 30. This allows the very end of the plank 30 near the pin which was so moved to move away from the back wall 18 of the primary slot 12, thereby allowing the plank 30 to change angle relative to the axis of the post 28. That is, in addition to angular movement around the end-to-end axis of the post 28, angular movement is also achieved relative to the end-to-end axis of the post 28. The essential element of this alternative embodiment is placement of the hole 32 and pin 34 so that the pin 34 does not force the end of the plank 30 into intimate contact with the back wall 18. If more than one pin 34 is used on the end of a plank 30, they may be placed in a staggered position relative to the end of the plank 30 for the aforementioned angular adjustment.

In further alternative embodiments, the primary slot 12 contains a subslot 26 which provides positive angular retention for the plank 30. That is, in many situations it is desirable to set the planks 30 at a fixed angle relative to each post 28 surface. Typically, but not always, this angle is a straight or inline (180°) angle. The subslot 26 is approximately the same width as the plank 30 and allows the plank 30 end to fit within. If the holes 32 and pins 34 are placed properly, the pins 34 ensure that the plank 30 butts near or against the bottom of the subslot 26 and is held in a fixed angle by said subslot 26 and the retaining action of said fulcrum points 27 and the pin 34 bearing upon the side walls 22, 23. Obviously, the subslot 26 may be placed at any location on said back wall 18 which provides the desired angle.

Further provided are fittings to hold said planks 30 in a proper position within said primary slot 12 and provide for a proper and finished look. These include a rail stop 38 to hold said plank 30 in the proper vertical position within said slot 12 and a filler cap 40 to cover said slot when a plank is not placed within. Conventional post caps to cover the slot cross section at the top of said post and bottom anchor strips to help further secure the lower portions of said plank are also used where appropriate. The rail stop 38 is simply a piece of material which fits into the primary slot 12 and prevents the plank 30 from sliding downward. The rail stop 38 may also be placed above the plank 30 in order to secure it within the slot 12. Often the rail stop 38 is attached to the back 18 and/or side walls 22, 23 of the primary slot 12. The filler cap 40 is typically a flexible vinyl, plastic or rubber material which fits into the slot 12 and covers the slot face 16 and opening 14. The anchor strip is typically a conventionally available "L" shaped bracket which is secured to the earth or other structure, typically by reinforcement rod, and positioned so that the lip of the "L" shape holds a portion of the plank. The anchor strip allows for greater weight retention, especially when the system is used for a retaining wall.

To install the aforesaid apparatus, the user first installs the aforesaid posts 28 with the proper footing. If not predrilled, the user drills holes 32 at the desired location near the end of the plank 30 which is ready for installation in the installed posts 28. If not precut, the user cuts pins 34 to the desired length for insertion into the aforementioned holes 32. The user then inserts one or more of said pins 34 into the holes 32 at the end of the plank 30 and slides said pin 34 and plank 30 end combination into one of said primary slots 12 from the topmost part of said post 28. That is, the plank 30 with pins 34 is slid within the primary slot 12 from the unmounted end of the post 28 to the desired position. If a pin 34 placement and length is chosen which does not force the plank 30 end into contact with the subslot 26, the user will be able to freely angularly adjust the plank 30 within the slot 12. If the user desires to take advantage of the fixed angle placement provided by the subslot 26, the user simply uses a longer pin 34 or redrills the holes 32 away from the plank 30 end. Should the user desire to place said plank 30 at a measured location within said slot 12, the user will place and secure a rail stop 38 within said slot 12 to limit the position of said plank 30. Typically, the user slides a plank 30 between two posts 28, both having the aforementioned primary slot 12. Since the present art allows for angular placement of said plank 30, the two posts 28 need not be perfectly aligned. This saves much time and effort of the installer and user of the present art.

Upon installation of the desired number of planks 30, the user may install a filler cap 40 into said slot 12 and over said slot face 16 and opening 14. Further installation of conventional anchor strips and post caps on the top of the posts 28 may follow thereafter.

From the foregoing description, those skilled in the art will appreciate that all objects of the present invention are realized. A system and apparatus for creating an angle adjustable retaining wall and fencing system which allows an installer to create a retaining wall, bin, fence, or related structure which may be placed with continuous angles between wall sections has been shown and described. The apparatus of this invention is able to provide continuous angle adjustment between wall sections and their respective posts without specialty tools, specialty labor or time consuming operations.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. An apparatus for creating an angle adjustable wall comprising:

one or more posts, each having a first end, a second end, an outer surface, and a primary slot within said outer surface, one or more planks each having a first end, a second end and a thickness, one or more of said ends of said planks inserted into said primary slot of said one or more posts, said primary slot having an opening on said outer surface which forms a slot face, said slot face having two edges which form fulcrum points, said edges separated greater than said thickness of said one or more inserted planks but not so great that said edges cannot operate as said fulcrum points, said primary slot further having a first side wall and a second side wall intersecting respectively each of said two edges which form said fulcrum points and angled outward and away from said fulcrum points and said ends of said planks such that said first side wall and said second side wall are separated a greater distance at all points other than at said two edges which form fulcrum points, said primary slot further having a back wall intersecting and connecting said first side wall and said second side wall and shaped to allow said plank to angularly move on said fulcrum points; and one or more pins slideably mounted within one or more holes within and near said end of said plank and located within said primary slot, whereby said pins butt against said side walls to hold said plank within said primary slot and move within said holes when said plank is angularly moved on said fulcrum points.

2. The apparatus for creating an angle adjustable wall as set forth in claim 1 whereby:

said end of said plank within said primary slot contacts said back wall; and said back wall is further shaped to contact said end of said plank when said plank is angularly moved on said fulcrum points.

3. The apparatus for creating an angle adjustable wall as set forth in claim 1 further comprising:

one or more rail stops mounted within said primary slot whereby said one or more planks are secured.

4. The apparatus for creating an angle adjustable wall as set forth in claim 1 further comprising:

one or more filler caps mounted onto and covering portions of said primary slot not containing a plank.

5. An apparatus for creating an angle adjustable wall comprising:

one or more posts, each having a first end, a second end, an outer surface, and a primary slot within said outer surface; and one or more planks each having a first end, a second end and a thickness, one or more of said ends of said planks inserted into said primary slot of said one or more posts, said primary slot having an opening on said outer surface which forms a slot face, said slot face having two edges which form fulcrum points, said edges separated greater than said thickness of said one or more inserted planks but not so great that said edges cannot operate as said fulcrum points, said primary slot further having a first side wall and a second side wall intersecting respectively each of said two edges which form said fulcrum points and angled outward and away from said fulcrum points and said ends of said planks such that said first side wall and said second side wall are separated a greater distance at all points other than at said two edges which form fulcrum points, said primary slot further having a back wall intersecting and connecting said first side wall and said second side wall and shaped to allow said plank to angularly move on said fulcrum points, said back wall having a subslot having a width slightly greater than said thickness of said end of said plank within said primary slot; and one or more pins slideably mounted within one or more holes near said end of said plank and within said primary slot, whereby said pins butt against said side walls to hold said plank within said primary slot.

6. The apparatus for creating an angle adjustable wall as set forth in claim 5 whereby:

said end of said plank within said primary slot butts within said subslot whereby said plank maintains a fixed angle relative to said slot face.

7. A method for forming an angle adjustable wall, the steps comprising:

forming one or more planks having a first end, a second end, a thickness, and one or more plank holes near said ends at a first distance from said respective end; and forming a primary slot in a post;

the steps of forming of said primary slot comprising;

forming a slot face opening having a width in an outer surface of said post, said width wider than said thickness of said plank; and forming within said post a first side wall and a second side wall which intersect said slot face and form fulcrum points at said intersection whereby said plank thickness is capable of fitting through said fulcrum points; and angling said side walls away from said fulcrum points thereby ensuring a distance between said side walls that is greater than said point of intersection and greater than said plank thickness; and forming and shaping a back wall between and connecting said side walls, whereby said primary slot has a second distance from said back wall to said slot face greater than said first distance from said plank holes to said respective plank end; and forming one or more pins capable of slidably fitting into said one or more plank holes and of sufficient length to contact said side walls when said plank end having said pins is inserted into said primary slot; and inserting said one or more pins into said plank holes; and sliding said plank end having said pins into said primary slot whereby one or more of said pins contact said side walls; and angularly moving said plank in relation to the plain of the said slot face whereby said plank reaches a position desirable for the application.

8. A method for forming an angle adjustable wall as set forth in claim 7, the steps further comprising:

forming a subslot having a width within said back wall; said width at least as wide as said thickness of said plank; and removing the one or more pins within said holes; and forming one or more new pins which slidably fit within said holes and which are longer than said removed pins; and placing said plank end within said primary slot and into said subslot whereby said new pins length is such that said new pins butt against said side walls and further force said inserted plank end into said subslot and lock said plank into a fixed position.

9. A method for forming an angle adjustable wall as set forth in claim 7, the steps further comprising:

forming a subslot having a width within said back wall; said width at least as wide as said thickness of said plank; and removing said plank and the one or more pins within said holes; and forming one or more new planks having a first end, a second end, said thickness, and one or more plank holes near said new plank ends at a third distance from said respective end which is greater than said first distance; and placing said one or more pins into said one or more holes in said new plank; and placing said new plank end within said primary slot and into said subslot whereby said pins positioning in said new plank holes is such that said pins butt against said side walls and further force said inserted new plank end into said subslot and lock said new plank into a fixed position.

* * * * *